United States Patent [19]

Pall et al.

[11] Patent Number: 4,702,947

[45] Date of Patent: Oct. 27, 1987

[54] FIBROUS STRUCTURE AND METHOD OF MANUFACTURE

[75] Inventors: David B. Pall, Roslyn Estates; Peter J. Degen, Huntington; Thomas C. Gsell, Glen Cove; Eleni C. Yanakis, Ridge, all of N.Y.

[73] Assignee: Pall Corporation, Glen Cove, N.Y.

[21] Appl. No.: 846,803

[22] Filed: Apr. 1, 1986

[51] Int. Cl.[4] ..... B32B 27/00

[52] U.S. Cl. ..... 428/36; 210/508; 427/244; 427/246; 428/290; 428/903

[58] Field of Search ..... 428/903, 290, 36; 427/244, 246; 210/508

[56] References Cited

U.S. PATENT DOCUMENTS

| | | | |
|---|---|---|---|
| 2,437,263 | 3/1948 | Manning | 18/8 |
| 2,539,768 | 1/1951 | Anderson | 210/204 |
| 3,238,056 | 3/1966 | Pall et al. | 117/98 |
| 3,309,222 | 3/1967 | Caldwell | 117/138.8 |
| 3,387,326 | 6/1968 | Hollberg et al. | 18/8 |
| 3,468,425 | 9/1969 | Engstrom | 210/490 |
| 3,826,674 | 7/1974 | Schwarz | 117/62.2 |
| 3,839,081 | 10/1974 | Tanahashi et al. | 117/138.8 |
| 4,007,113 | 2/1977 | Ostreicher | 210/23 |
| 4,007,114 | 2/1977 | Ostreicher | 210/23 |
| 4,230,573 | 10/1980 | Kilty et al. | 210/767 |
| 4,238,193 | 12/1980 | Kisaichi et al. | 8/115.5 |
| 4,293,600 | 10/1981 | Fink et al. | 427/385.5 |
| 4,305,782 | 12/1981 | Ostreicher et al. | 162/181 |
| 4,473,475 | 9/1984 | Barnes, Jr. et al. | 210/638 |
| 4,523,995 | 6/1985 | Pall et al. | 210/504 |
| 4,617,124 | 10/1986 | Pall et al. | 210/638 |

FOREIGN PATENT DOCUMENTS

| | | |
|---|---|---|
| 1457034 | 12/1976 | United Kingdom . |
| 2068432 | 8/1981 | United Kingdom . |
| 2098590 | 8/1983 | United Kingdom . |

*Primary Examiner*—James J. Bell

*Attorney, Agent, or Firm*—Leydig, Voit & Mayer

[57] ABSTRACT

Polymeric microfibrous structures comprised of normally hydrophobic microfibers coated with a cured, precipitated, cationic, thermosetting binder resin or polymer and characterized by being hydrophilic and having a positive zeta potential with enhanced capability for the removal of negatively-charged particulate material in a fluid medium are prepared by a process comprising the steps:

(1) combining in a controlled manner a first solution of a water-soluble, non-colloidal, cationic, thermosetting binder resin or polymer and a second solution or dispersion of a precipitating agent to form a stable emulsion or suspension;

(2) impregnating the microfibrous structure of normally hydrophobic microfibers with the stable emulsion or suspension to form a fibrous structure wetted with the stable emulsion or suspension; and (3) drying the wetted microfibrous structure and curing the binder resin or polymer.

23 Claims, No Drawings

FIBROUS STRUCTURE AND METHOD OF MANUFACTURE

TECHNICAL FIELD

This invention relates to fibrous structures. More particularly, this invention is directed to cylindrical fibrous structures useful as filters and having improved efficiencies for the removal of particulates in a variety of fluid clarification applications.

BACKGROUND ART

Fibrous structures formed from a variety of materials, including natural and synthetic fibers in both staple and continuous form, woven or nonwoven, have long been known and used in filter operations. They are formed into a variety of shapes, e.g., cylindrical cartridge filters, and operate as depth filters.

A particularly useful filter of this type is disclosed in the pending U.S. application of Pall et al, Ser. No. 568,824, filed Jan. 6, 1984 (U.S. Pat. No. 4,594,202), and the corresponding published EPO Application Ser. No. 84309094.5 (Publication Number 0 148 638), the disclosures of which applications are incorporated herein by reference. The cylindrical filter elements disclosed therein comprise a fibrous mass of nonwoven, synthetic, polymeric microfibers. The microfibers are substantially free of fiber-to-fiber bonding and are secured to each other by mechanical entanglement or intertwining. The fibrous mass, as measured in the radial direction, has a substantially constant voids volume over at least a substantial portion of the fibrous mass. Preferably, it also has a graded fiber diameter structure over at least a portion thereof.

Depth filters function by mechanical straining of particles as they pass through the pores in the structure. In mechanical straining, particles are removed by physical entrapment as they attempt to pass through pores smaller than themselves. The filtering capability of such filter elements, therefore, is determined in large part by the lower limit on pore size.

Somewhat smaller pores can be formed by decreasing fiber diameter, e.g., at a constant voids volume finer fibers will yield smaller pores. Unfortunately, reducing the pore size, while it improves the filtering capability, increases the pressure drop and adversely affects filter life.

A filter may also remove suspended particulate material by adsorption onto the filter surfaces. Removal of particulate material by this mechanism is controlled by the surface characteristics of the suspended particulate material in the filter medium. Most suspended solids which commonly are subjected to removal by filtration are negatively charged in aqueous systems near neutral pH. This has long been recognized in water treatment processes where oppositely charged, cationic flocculating agents are employed to improve settling efficiencies during water clarification.

Colloidal stability theory can be used to predict the interaction of electrostatically charged particles and surfaces. If the charges of a particle in the filter sheet surface are of like sign and have zeta potentials of greater than about 20 millivolts (mV), mutual repulsive forces will be sufficiently strong to prevent capture by adsorption. If the zeta potentials are small, or more desirably, the suspended particles and the filter surface have opposite signs, the particles will tend to adhere to the filter surface with high capture efficiency. Thus, filter materials characterized by positive zeta potentials are capable of removing, by electrostatic capture, negatively charged particles much smaller than the pores of the filter.

Synthetic, polymeric microfibers of the type disclosed in U.S. application Ser. No. 568,824, e.g., polypropylene microfibers, have negative zeta potentials in alkaline media. Accordingly, their ability to remove negatively charged, suspended, particulate material by adsorption is limited. Additionally, they are hydrophobic. Thus, a filter comprising such microfibers, at a given applied pressure, has lower fluid flow rates than would an otherwise comparable filter comprised of hydrophilic microfibers. In other words, if hydrophobic microfibers are used, one must accept either a higher pressure drop across the fibrous mass or a reduced flow rate.

Synthetic, polymeric microfibers, though hydrophobic, do have desirable features. They are resistant to chemical attack. They also are clean, i.e., filter media migration is low. It would be highly desirable to retain the attractive features of polymeric microfibers, and of fibrous structures made therefrom, while obtaining the benefits of hydrophilicity and a positive zeta potential.

A process for treating normally hydrophobic, microfibrous, polymeric webs to form hydrophilic, microfibrous, polymeric filter sheets with positive zeta potentials is disclosed in Pall et al., U.S. patent application Ser. No. 397,762, filed July 13, 1982, and in the corresponding EPO Application Ser. No. 83.303952.2 (Publication No. 0 099 699), the disclosures of which are incorporated herein by reference. The process generally comprises:

(1) applying a first solution or dispersion of precipitating agent to a hydrophobic web comprised of polymeric microfibers to at least partially wet the web with the first solution;

(2) applying a second solution of a water-soluble, non-colloidal, cationic, thermosetting binder resin or polymer to the wetted web of step (1) above to form a web wetted with a mixture of the first solution or dispersion and the second solution;

(3) working the wetted web of step (2) above to mix the first solution or dispersion and the second solution, thereby facilitating the precipitation of the binder resin or polymer and the distribution in a uniform manner of the precipitated binder resin or polymer as a coating on the surfaces of the microfibers making up the worked web; and (4) drying the coated web of step (3) above and curing the precipitated binder resin or polymer coating.

While that process provides excellent results with thin, flexible, fibrous, filter sheets, thin webs, and the like, for thicker three-dimensional structures characterized by structural rigidity, e.g., the fibrous cylindrical structures disclosed in U.S. patent application Ser. No. 568,824, it is less satisfactory since working of the structure to mix the first and second solutions in a uniform manner is difficult, if not impossible. The result can be uneven laydown of the coating since the working possible with thinner, non-rigid fibrous material which facilitates the precipitation of the binder resin or polymer and distribution of the precipitated binder resin in a uniform manner is not possible. As used herein, the term "structural rigidity" refers to the characteristic of three-dimensional microfibrous structures being insufficiently flexible to allow them to be worked or manipulated to an extent that a uniform distribution of binder resin can be accomplished as described above.

The present invention, then, is directed to fibrous structures, particularly cylindrical depth filters, and a process for their manufacture. Fibrous structures prepared in accordance with the method of this invention are hydrophilic and have positive zeta potentials. As a consequence of the hydrophilicity and positive zeta potential, they have reduced pressure drops at given flow rates as compared to hydrophobic counterparts and enhanced particulate stability for removal of negatively charged particulate material in fluid media.

DISCLOSURE OF THE INVENTION

This invention is directed to a process for converting a hydrophobic, polymeric, microfibrous structure to a hydrophilic form exhibiting a positive zeta potential. In carrying out the process two liquid-based compositions are used:

(1) a first solution of a water-soluble, non-colloidal, cationic, thermosetting binder resin or polymer; and (2) a second solution or dispersion of a precipitating agent.

These are combined in a controlled manner to form a stable emulsion or suspension of the precipitating agent and binder resin or polymer as coprecipitates. The microfibrous structures are then impregnated with the stable suspension to wet the structure with the stable emulsion or suspension, i.e., to cover the microfibers or saturate the structure with the stable emulsion or suspension, excess material, if any, is removed, the microfibrous structure is dried, and the binder resin or polymer is cured to form the desired product.

This invention is also directed to three-dimensional, hydrophilic microfibrous structures with positive zeta potentials useful as filter media. In particular, this invention is directed to microfibrous structures, such as cylindrical depth filters, comprising normally hydrophobic microfibers and a cured, precipitated, cationic, thermosetting binder resin or polymer coating on the microfibers, the microfibrous structure being hydrophilic and having a positive zeta potential with enhanced capability for the removal of negatively-charged particulate material in a fluid medium.

BEST MODE FOR CARRYING OUT THE INVENTION

Fibrous Structures

The normally hydrophobic, microfibrous structures which may be treated by the subject process are composed of normally hydrophobic, polymeric microfibers. Such microfibers typically have diameters of from about 0.5 to about 20 micrometers, preferably from about 1.0 to about 10 micrometers. They may vary in length from relatively short staple-like microfibers of about 0.5 inch or less up to substantially continuous filaments several feet or more in length.

The normally hydrophobic, polymeric microfibers may be prepared from melt-spun polymeric microfibers, such as polyolefins, e.g., polypropylene and polyethylene; polyesters, e.g., polybutylene terephthalate and polyethylene terephthalate; and polyamides, e.g., polyhexamethylene adipamide (nylon 66), polyhexamethylene sebacamide (nylon 610); nylon 11, prepared from 11-amino-nonanoic acid; and homopolymers of poly-e-caprolactam (nylon 6). The microfibers may be made of other polymers which can be formed into microfibers, particularly those which can be meltspun to form microfibers of from about 0.5 to about 20 micrometers. Mixtures of microfibers also may be used.

The microfibers of these polymers are hydrophobic prior to conversion to a hydrophilic form by the process of this invention and have a negative zeta potential in alkaline media. As used herein, the term "hydrophobic" means not wetted by water, as evidenced by a high angle of contact at the water-microfiber or water-microfibrous structure interface. Also as used herein, the term "hydrophilic" means readily wetted by water, which is visually observable by the rapid spreading of a drop of water placed in contact with the microfibrous structure, i.e., a zero contact angle.

The microfiber structure treated in accordance with the subject invention may have a variety of shapes, e.g., sheet-like webs, three-dimensional structures, such as cylinders, and the like. Methods of making such structures are well known in the art. For example, webs may be formed by the methods disclosed in V. White, "The Manufacture of Superfine Organic Fibers", (U.S. Department of Commerce, Naval Research Laboratory, Publication No. PB111437, 1954). The method or process in accordance with the subject invention is particularly useful for treating three-dimensional structures, such as cylindrical fibrous depth filters, particularly those having structural rigidity precluding working as described above.

Cylindrical fibrous structures may be prepared according to the disclosure of U.S. application Ser. No. 568,824, referred to above. Structures made in accordance with the process disclosed therein are commercially available from Pall Corporation, Glen Cove, New York, under the trademark PROFILE.

In general, the cylindrical fibrous structures described in U.S. application Ser. No. 568,824 are prepared by a process comprising:

(a) extruding synthetic, polymeric material from a fiberizing die and attenuating the extruded polymeric material to form said synthetic, polymeric microfibers by the application of one or more gas streams directed toward a rotating, reciprocating mandrel and a rotating forming roll in operative relationship with the mandrel;

(b) cooling the synthetic, polymeric microfibers prior to their collection on the mandrel to a temperature below that at which the microfibers bond or fuse to each other, thereby substantially eliminating fiber-to-fiber bonding; and (c) collecting the cooled microfibers on the mandrel as a nonwoven, synthetic fibrous mass while applying a force to the exterior surface of the collected microfibers by the forming roll wherein the process variables are controlled to form the cylindrical fibrous structure with the fibrous mass, as measured in the radial direction, having a substantially constant voids volume over at least a substantial portion thereof, and preferably varying fiber diameter over at least a substantial portion thereof in the radial direction to achieve a varying pore size over that portion. Cylindrical fibrous structures prepared in accordance with the disclosure of U.S. Ser. No. 568,824 may have absolute removal ratings ranging from as low as about 0.5 up to about 40 micrometers or, if desired, higher, e.g., up to 70 micrometers.

In addition to those cylindrical fibrous structures disclosed in U.S. application Ser. No. 568,824, the process in accordance with this invention can also be used to treat other cylindrical, hydrophobic, polymeric fibrous structures as well as other three-dimensional fibrous structures which are difficult to manipulate or work due to their structural rigidity.

Suitable Binder Resins/Polymers

The binder resins/polymers useful in preparing the fibrous structures of the subject invention are the water-soluble, non-colloidal, cationic, thermosetting binder resins/polymers (sometimes "WNCT binder resins" or "binder resins" herein). Many such binder resins are readily available from commercial manufacturers in various forms and have found extensive use in paper manufacture as wet strength additives. The general characteristics and uses of these materials are described in, e.g., J. Blair, *Amino Resins,* (Rheinhold Publishing Company, New York, 1959); "Wet Strength In Paper And Paper Board", (Tappi Monograph Series No. 29, 1965); E. Goethals, "Polymeric Amines and Ammonium Salts", (Pergamon Press, New York, 1980). The epoxide-based water-soluble resins are preferred. Suitable epoxide-based water-soluble, cationic, thermosetting polymers commercially available include both polyamido/polyaminoepichlorohydrin resins and polyamine-epichlorohydrin resins.

The WNCT binder resins used in this invention must meet several requirements. They must have the ability, while in the uncured state, to form true solutions in water. In this regard, the class of binder resins useful in this invention are, as described above, water-soluble and non-colloidal. By this is meant that the solution of the binder resin is prepared in a non-colloidal state. It does not mean that the binder resin is incapable of forming a colloid under appropriate conditions, only that this is an undesirable form for purposes of this invention.

A second requirement is that the binder resin must be capable of being cured into the crosslinked state by a simple conversion process involving no more than time, temperature and, optionally, a catalyst.

Still another requirement of the binder resins of this invention is relative insensitivity to water swelling. Water swelling polymers lose mechanical strength as they swell. Crosslinking to a polymer reduces susceptibility to swelling and the mechanical integrity of formed structures containing the polymer is enhanced correspondingly.

A desired characteristic of the binder resins useful in this invention is the presence of a high proportion of cationic charges. Additionally, the cationic charges preferably should not simply rely on protonation. Rather, the charges should stem from quaternized ammonium groups whose cationicity is independent of pH.

Particularly preferred WNCT binder resins are those containing a substantial number of quaternary ammonium groups derived from any suitable aliphatic amine which has been fully quaternized.

Representative WNCT binder resins which may be used to prepare the fibrous structures of this invention include those described in U.S. Pat. Nos. 2,926,154, 3,332,901, 3,224,986 and 3,855,158, the disclosures of which are incorporated herein by reference. Commercially available WNCT binder resins of the polyamido/-polyamino-epichlorohydrin class, which are preferred for purposes of this invention, as available under the trademarks KYMENE 557 and the POLYCUP series of resins manufactured by Hercules Incorporated.

Especially preferred WNCT binder resins are the polyamine-epichlorohdrin resins which contain quaternary ammonium groups. Resins of this type are made by reacting polyamines with epichlorohydrin and differ from the polyamido/polyamino-epichlorohydrin resins in several respects. They do not contain amide linkages in their composition and, contrary to commercial polyamido/polyamino-epichlorohydrins, derive a substantial degree of their cationicity from the presence of quaternary ammonium groups. Commercial compositions of this type are prepared by reacting epichlorohydrin with condensation products of polyalkylene polyamides and ethylene dichloride. Compositions of this type are disclosed in U.S. Pat. No. 3,855,158 and are exemplified by SANTO-RES 31, a product of Monsanto Inc.

Another form of this particularly preferred type of WNCT binder resin is prepared by the reaction of epichlorohydrin with polydiallyl methyl amine to produce an epoxide functional quaternary ammonium resin. Compositions of this kind are disclosed in U.S. Pat. No. 3,700,623 and are exemplified by Resin R4308, a product of Hercules Incorporated. The disclosures of U.S. Pat. Nos. 3,855,158 and 3,700,623 are incorporated herein by reference.

Both these preferred classes of binder resins are epoxy functional, cationic, thermosetting classes which derive cationicity from quaternary ammonium groups and provide positive zeta potential in alkaline pH.

Many of the WNCT binder resins useful in the subject invention require activation. For the purpose of providing extended shelf life and storage stability to these resins, the epoxide groups are chemically inactivated to prevent premature cross-chemically linking of these resins. Thus, prior to the use of these resins for purposes of the present invention, the resins are activated into the reactive, thermosetting state by regeneration of the epoxide groups. Typically, activation entails adding sufficient aqueous caustic to a solution of the inactive resin to chemically convert the inactive chlorohydrin form to the crosslinking epoxide forms. The parts by weight of aqueous caustic per parts by weight of resin vary with the product and are specified by the manufacturer. The activation process is efficient and complete activation is generally achieved in about 30 minutes.

Precipitating Agents

A variety of precipitating agents are suitable in the practice of this invention. As a first requirement or limitation on the selection of appropriate precipitating agents, the material must be water-soluble or water-dispersible and have the ability to precipitate the WNCT binder resin from aqueous solution. Synthetic water-soluble or -dispersible precipitating agents which are derived from natural or synthetic polymers are preferred. These types of agents are available from many commercial manufacturers and their properties and compositions are described in, for example, H. Hamza et al, INDEX OF COMMERCIAL FLOCCULANTS (1974), *Canmet Report* 77–78, (Canada Centre For Mineral And Energy Technology, Canada, 1975), and R. Booth et al, *Ind. Min. J.* 335 (Special Issue 1957). Precipitation of the WNCT binder resin onto the microfiber surfaces by the addition of high molecular weight polymers containing anionic charges has been found especially effective.

Since the anionic precipitating agents preferably used in this invention contain carboxyl or other ionizable acidic groups, their precipitating efficiency is a function of pH. Accordingly, the preparation of the WNCT binder resin coated polymeric webs used to prepare the fibrous structures of this invention is most effectively carried out at pH conditions wherein the anionic groups are substantially completely ionized and provide the highest precipitation efficiency, that is, preferably under alkaline conditions.

Additionally, it may be desirable, with some carboxylate precipitating agents, to convert some of the carboxylic acid groups therein to their salt form by neutralization with inorganic bases, e.g., sodium hydroxide, or organic bases, e.g., diethanolamine or triethanolamine. This treatment improves the solubility of the precipitating agent and, in some instances, improves the wetting characteristics of the solution or dispersion of the precipitating agent in the treatment of the hydrophobic web.

The preferred precipitating agents may be selected from a group of synthetic, water-soluble or-dispersible polymers containing anionic groups such as carboxylate or sulfonate. The carboxylate-containing polymers, such as acrylic acid copolymers, are especially preferred due to their efficiency, wide availability and low cost. Suitable precipitating agents for the purposes of this invention include anionics such as the HERCOFLOCS manufactured by Hercules Incorporated, the PURIFLOCS manufactured by Dow Chemical Corporation and the NALCOLYTE series of anionic flocculants manufactured by Nalco Chemical Company. Suitable commercial precipitating agents include NALCOLYTE 7763, 7766 and 7173, Product 18,127-7 (Aldrich Chemical Company) and CARBOSET 531 (B. F. Goodrich Company). NALCOLYTE 7766 and 7173 are high molecular weight (greater than one million) copolymers of acrylamide and sodium acrylate. NALCOLYTE 7763 is a copolymer having a molecular weight of from about 5 to 10 million prepared by reacting about 35 percent acrylic acid and about 65 percent acrylamide. The general structures of these materials are set out in U.S. Pat. Nos. 3,549,527, 3,617,542 and 3,673,083. They are ionic flocculating agents with the extent of ionicity determined by the relative proportion of sodium acrylate in the polymer. They are prepared by the controlled hydrolysis of polyacrylamide to polyacrylamide-coacrylate and also by the direct copolymerization of acrylamide with sodium acrylate. Product 18,127-7 is a polyacrylamide with a molecular weight of 5 to 6 million. The particularly preferred precipitating agent, CARBOSET 531, is a water-soluble, self-catalyzed, thermosetting, acrylic resin with a molecular weight of about 1 million. It is believed to contain N-methylol acrylamide groups and acrylic acid groups through which the crosslinking occurs.

Concentrations Of The Various Constituents

The concentration of the WNCT binder resin in the first solution may typically vary from about 0.2 percent to about 2 percent in the practice of the process of this invention. (All parts and percentages herein are by weight based on the weight of the total composition of the particular solution, dispersion or other entity under consideration unless otherwise specified.) More typically, the range will be from about 0.3 to about 0.8 percent. Preferably, the first solution contains a mixture of water and a lower alcohol, e.g., t-butyl alcohol, as the solvent. The alcohol assists in the penetration or impregnation of the stable suspension into the hydrophobic fibrous structure. The lower alcohol may be present in the first solution in an amount ranging from about 10 to 50 weight percent based on the total weight of the alcohol and water, more preferably from about 15 to about 30 weight percent.

The WNCT binder resin preferably will coat the fibrous structure in an amount such that the total weight of the binder resin solids added, based on the dry weight of the fibrous structure prior to any treatment, ranges from about 0.5 percent to as high as about 4 percent, preferably from about 0.8 to about 3 percent. It should be understood, as discussed elsewhere herein, that the precipitating agent is, in the course of precipitating the binder resin chemically bound and/or physically intermixed with the binder resin and thereby may become a part of the coating on the microfibers. The percentages set out immediately above, therefore, may not reflect the actual amount of binder resin coated on the fibers, but rather the amount of a binder resin/precipitating agent composite in the coating, i.e., the amount of weight pickup by the microfibrous structure after drying and curing is complete.

The concentration of the precipitating agent in the second solution/dispersion is typically in the range of from about 0.05 to about 1 percent. Preferably, the precipitating agent will be present in the second solution/dispersion in an amount of from about 0.1 to about 0.3 percent. Preferably, the second solution/dispersion contains a mixture of water and a lower alcohol, e.g., t-butyl alcohol, as the solvent/carrier. As noted above, the alcohol assists in the penetration or impregnation of the stable suspension into the hydrophobic fibrous structure. The lower alcohol may be present in the second solution/dispersion in an amount ranging from about 10 to 50 weight percent based on the total weight of the alcohol and water, more preferably from about 15 to about 30 weight percent.

The amount of precipitating agent used will vary with the specific nature of the WNCT binder resin and the precipitating agent combination. Preferably, the relative weight proportion of the precipitating agent should be at levels no greater than that of the WNCT binder resin. It should be understood that the relative weight proportions of the precipitating agent and the binder resin referred to herein are the amounts present in the stable suspension or emulsion just prior to impregnation of the fibrous structure.

For the preparation of hydrophilic, microfibrous, polymeric fibrous structures, particularly with the preferred binder resin, Resin R4308, and the preferred precipitating agent, CARBOSET 531, the preferred weight ratio of binder resin to precipitating agent (solids) in the stable emulsion or suspension is preferably in the range of from about 4:1 to about 1:1, more preferably from about 3:1 to about 1:1.

The Stable Suspension

The method of preparing the suspension is critical to obtain the requisite stable emulsion or suspension. Typically, mild shear rates are used while mixing the two solutions. For example, a short (e.g., 2 to 3 inches long) cylindrical magnetic stirrer rotating at from about 20 to about 60 RPM at the bottom of the container in which the two solutions are combined may be used. Alternatively, a similarly shaped structure supported on a driven mixing rod extending into the container and operating at low RPM, e.g, about 20 to about 60 RPM, may also be used. Moreover, the addition of the WNCT binder resin solution to the second (precipitating agent) solution or dispersion should be gradual and non-violent, e.g., by use of a multiplicity of capillary orifices about 0.040 inch in diameter or less located just above the level of the second solution or dispersion.

A blade mixer is less desirable because of the shearing action. High RPM and high shear should be avoided because of the likelihood of the formation of an unstable suspension which will rapidly settle out, typically in 5 minutes or less, or in the formation of particles which are larger than the fibrous structure to be treated.

The stability of the suspension may be defined by settling time. In accordance with the subject invention, there is no noticeable layering or settling of the suspension even after 24 hours. The stabilized suspension or emulsion has particles of between about 0.01 and about 10 micrometers in diameter, more typically between about 0.01 and about 3 micrometers. The stabilized suspension or emulsion contains both WNCT binder resin or polymer and the precitipating agent. If the suspension is not used immediately, it should be stored in a quiescent fashion.

It is believed that the stabilized emulsion or suspension causes the formation of a precipitated form of the cationic binder resin which adheres efficiently to the surfaces of the microfibers. The interaction of the binder resin or polymer with the precipitating agent may result in the precipitating agent adhering to the microfibers or adhering to adhered binder resin. It should, therefore, be understood that the coating composition of the polymeric microfibers may contain a proportion of the precipitating agent.

It also is believed that the remarkable ability to control the quantity of cationic binder resin deposited on the polymeric microfibers by precipitation in the manner described herein may result, in part, from favorable zeta potential interactions between the cationic binder resin precipitate and the surfaces of the microfibers in the fibrous structure. Such interactions are known to be complex, and various other mechanisms, such as electrostatic bonding, hydrogen bonding or other physicochemical interactions, may be responsible in whole or in part for the extremely desirable results obtained.

Whatever the detailed interactions may be, it has been found that saturating a normally hydrophobic, synthetic polymeric fibrous structure with a coprecipitate suspension/emulsion of a polymeric anionic precipitating agent and water-soluble, noncolloidal, cationic, thermosetting binder resins/polymers leads to the efficient coating of the surface of the microfibers in the fibrous structure by the cationic binder resin. The small quantities of binder resin/polymer required to control the zeta potential of the structure is believed to be a reflection of the efficiency and substantial uniformity with which the surfaces of the microfibers are coated by the method described.

Impregnation

The impregnation step may be accomplished by simply dipping the fibrous structure in the stable suspension and draining any excess suspension. Other conventional methods may also be used. Preferably, the structure is saturated to provide uniform coating.

In the case of an annular cylindrical fibrous structure, impregnation may be accomplished by inserting the co-precipitate suspension into the interior of the cylinder and rotating the cylinder in a horizontal position at, e.g., 1,000–2,000 RPM. Rotation provides for an even distribution of the suspension, as well as forcing the suspension through the filter at a greater rate than does simple immersion. Moreover, any excess of the suspension is spun from the cylinder, thereby shortening drying and curing time, avoiding excessive levels of coating material in the structure, and allowing recovery of the spun-off suspension for use in treating other cylinders. Most importantly, spinning the cylinder, as opposed to simply dipping the structure, coats the fibers uniformly while at the same time leaving little or no excess liquid in the pores, thereby preventing or reducing migration during the drying step and producing a more uniform coating of the fibers. Migration can otherwise occur because of gravity and the natural tendency for the still wet emulsion to migrate toward the surface where drying first occurs due to capillary action.

Drying And Curing

The term "drying" is used herein to primarily describe the phenomenon by which volatile materials, e.g., water, are removed from the saturated fibrous structure. It should be understood, however, that the precipitated binder resin coating the surfaces of the microfibers also is cured to convert the binder resin into a crosslinked, mechanically strong and water-insoluble form providing enhanced bonding between the microfibers making up the structure. The two phenomena may be part of a continuum with curing occurring as the drying process is carried out.

Curing is accelerated by the use of elevated temperatures and by the removal of water from the saturated structure. Drying and curing also may be carried out at ambient temperatures over an extended period, dependent upon the particular combination of binder resin and precipitating agent. Drying and curing are effected more expeditiously by the use of elevated temperatures between about 80 and about 130 degrees Centigrade for from about 6 to about 16 hours. Preferably, drying is accomplished by placing the element in a forced air convection oven at a temperature of between about 80 and about 105 degrees C. for a period of about 6 to about 12 hours.

The conversion of hydrophobic fibrous structures having negative zeta potentials in alkaline media to hydrophilic fibrous structures having (i) positive zeta potentials in alkaline media with concomitant enhanced particle removal efficiencies for negatively charged particles, (ii) enhanced flow rates at a given applied pressure, and (iii) enhanced mechanical strength are substantial improvements in the properties of this type of filtering media. The invention will be better understood by reference to the the following examples.

Method Of Testing The Fibrous Structures

The properties of the fibrous structures, and of filter elements made therefrom, of the following examples were evaluated by the test methods described below.

(a) Zeta Potential

The zeta potentials of the microfibrous filter structures were calculated from measurements of the streaming potentials generated by flow of a 0.001 weight percent solution of KCl in distilled water through the filter element. Zeta potential is a measure of the net immobile electrostatic charge on a filter element surface exposed to a fluid. It is related to the streaming potential generated when that fluid flows through the filter by the following formula:

$$\text{Zeta Potential (mV)} = 4\pi\eta/D \cdot E_s\lambda/P$$

where $\eta$ is the viscosity of the flowing solution, D is the dielectric constant of the solution, $\lambda$ is its conductivity, $E_s$ is the streaming potential, and P is the pressure drop across the filter element during the period of flow, J. Davis et al, INTERFACIAL PHENOMENA, (Academic Press, New York 1963). In the following examples, the quantity $41\pi\eta/D$ is constant, having the value $2.052\times10^{-2}$, making the zeta potential equal to:

$$\text{Zeta potential (mV)} = 2.052\times10^{-2}\cdot E_s\,(\text{Volt})\cdot\lambda(\mu\text{mho/cm})/P\,(\text{psi})$$

(b) OSU F-2 Filter Performance Test (Aqueous Particulate Removal Efficiency Test)

A procedure for determining filter removal ratings in aqueous service is the OSU F-2 Filter Performance Test which has gained wide acceptance in various industries. The apparatus used is an automatic particle counter, Model 4100, available from Pacific Scientific Company (Hiac-Royco Instruments Division). The device has an HR-60 sensor upstream, an HR-60 sensor downstream, and allows the rapid challenge of test elements with an aqueous suspension of silicious test dust in the particle diameter range of from 0.1 to 40 micrometers. The apparatus has two sets of six channel particle counters which can be set to any six preselected particle sizes in the range of from 1 to 40 micrometers in diameter and automatically records particle concentrations in the incident flow and effluent flow from the filter. The apparatus also automatically records the ratio known as beta ($\beta$), which is the ratio of the number of incident particles to the number of effluent particles at each of the six particle diameters selected. Beta is related to particle removal efficiency, expressed as percent removal, as follows:

$$\%\ \text{removal (efficiency)} = 100(1-1/\beta).$$

General Method For Preparing The Fibrous Structures Of The Examples

Annular, cylindrical, polypropylene, fibrous, hydrophobic filter structures, each having a $\beta$ of about 5,000 at 5 micrometers as measured by the OSU F-2 Filter Performance Test (available from Pall Corporation under the trademark PROFILE RIF050), were used in the following examples and were treated (other than the controls) by the following general method.

A first solution was prepared containing 0.550 weight percent R4308 resin solids in a mixture of 20 weight percent t-butyl alcohol and 80 weight percent water. Prior to the combination of a water/t-butyl alcohol mixture with the R4308 resin, the R4308 resin was activated with NaOH using the procedure described above with the R4308 resin in the form of a 2 weight percent solution in water. After activation, a sufficient amount of a water/alcohol mixture was added to provide the desired solution containing 0.550 weight percent R4308 in a mixture of 20 weight percent t-butyl alcohol and 80 weight percent water.

A second (precipitating agent) solution was prepared containing 0.135 weight percent CARBOSET 531 active solids (available from B. F. Goodrich Company) in a mixture of 20 weight percent t-butyl alcohol and 80 weight percent water. Diethanolamine (0.1 weight percent) based on the total weight of the precipitating agent solution was admixed into the solution as a neutralizing agent for the CARBOSET 531.

A stable suspension was prepared by combining 2 parts by weight of the first binder resin solution with 3 parts by weight of the second precipitating agent solution. The combination was accomplished by adding the first solution to the second solution via multiple capillary needles having an inner diameter of about 0.015 inch from a height of 3 inches above the second solution while slowly mixing the second solution at a rate of 30 RPM with a magnetic stirring bar 0.375 inches in diameter and about 2.5 inches long. This resulted in a stable suspension having a weight ratio of binder resin or polymer to precipitating agent (solids) of 2.7:1 of WNCT binder resin to precipitating agent.

Impregnation of the annular cylindrical filter structure was accomplished by applying the stable suspension to the inside diameter of the structure while rotating it in a horizontal position at a speed of 1,200 RPM..

The structure was dried by placing it in a forced air convection oven at a temperature of 200 degrees Fahrenheit for a period of 12 hours. The cylindrical filter element showed a weight gain of about 1.7 weight percent based on the weight of the fibrous portions of the filter element.

EXAMPLE 1

A Profile RIF050 filter element as described above was treated according to the General Method set out above. An otherwise identical but untreated filter element (control) was tested along with the treated one for zeta potential by the zeta potential test method (a) described above. The results are reported below in Table 1.

TABLE 1

| Filter Element | Zeta Potential at a pH of 8 in millivolts |
|---|---|
| Profile (treated, positively charged, hydrophilic) | +34.7 mV (average) |
| Profile (untreated control) | −63.6 mV (average) |

The above results indicate that a structure treated in accordance with the method of this invention exhibits a positive zeta potential in an alkaline medium in contrast to the control (untreated structure) which had a strong negative zeta potential.

EXAMPLE 2

A Profile RIF050 filter element treated according to the General Method set out above was tested using the OSU F-2 Filter Performance Test (b) as described above. An untreated Profile RIF050 filter element (control) was similarly tested. The flow rate through each filter element was maintained at 10 liters per minute throughout the test. The results of those tests, measuring the influent and effuent at a particle size of 1 micrometer, are listed below in Table 2.

TABLE 2

| Filter Element | $\beta$ value (after 1 hour on stream) |
|---|---|
| Profile (treated, positively charged, hydrophilic) | 120,000 |
| Profile (untreated control) | 43 |

These results illustrate the remarkable improvement in efficiency attained by a structure in accordance with this invention compared with an otherwise comparable but hydrophobic and negatively charged structure.

Filter structures prepared in accordance with the subject invention find use in a variety of applications. One particular application is in the removal of pyrogens. Pyrogens, also called endotoxins, are generated by many bacteria after the bacteria are killed. Pyrogens are highly toxic to humans, indeed to mammals in general, and minute quantities, for example, a concentration as low as 1/1,000 milligram, may cause a severe rise in body temperature. If present in excessive concentrations, they cause death. Accordingly, pyrogen-free water must be used for dissolving medications injected into the human body, and the medications themselves must not be contaminated by pyrogens. Negatively-charged pyrogens are removed to a harmless level by passing the liquid through an appropriate filter prepared in accordance with this invention. A single annular, cylindrical cartridge 10 inches in length with a relatively fine pore rating can remove such pyrogens to harmless levels from as much as several hundred gallons of liquid.

We claim:

1. A process for converting a hydrophobic, polymeric, microfibrous structure to a hydrophilic form exhibiting a positive zeta potential comprising:

(1) combining in a controlled manner a first solution of a water-soluble, non-colloidal, cationic thermosetting binder resin or polymer and a second solution or dispersion of a precipitating agent to form a stable emulsion or suspension of the precipitating agent and the binder resin or polymer as co-precipitates;

(2) impregnating the microfibrous structure with the stable emulsion or suspension to form a microfibrous structure wetted with the stable emulsion or suspension; and (3) drying the wetted microfibrous structure of step (2) and curing the binder resin or polymer to provide a hydrophilic, polymeric, microfibrous structure with a positive zeta potential, the surfaces of the microfibers of the structure being coated with a cured, precipitated, thermoset, cationic binder resin or polymer.

2. The process of claim 1 wherein the microfibers of the microfibrous structure comprise a polymer selected from the group consisting of polyolefins, polyamides, and polyesters.

3. The process of claim 2 wherein the concentration of the binder resin or polymer in the first solution is in the range of from about 0.2 to about 2 weight percent, the concentration of the precipitating agent in the second solution or dispersion is in the range of from about 0.05 to about 1 percent, and the weight ratio of binder resin or polymer to precipitating agent in the stable emulsion or suspension is in the range of from about 4:1 to about 1:1.

4. The process of claim 3 wherein the stable emulsion or suspension comprises a co-precipitate of precipitating agent and the binder resin or polymer, water, and a lower alcohol.

5. The process of claim 4 wherein the stable suspension is prepared by combining the first solution and the second solution or dispersion at mild shear rates provided by a stirrer operating at from about 20 to about 60 RPM and with the binder resin or polymer solution added to the second solution or dispersion of a precipitating agent by use of a multiplicity of capillary orifices located just above the level of the second solution or dispersion.

6. The process of claim 4 wherein the first solution comprises the binder resin or polymer, water, and t-butyl alcohol and the second solution or dispersion comprises the precipitating agent, water and t-butyl alcohol.

7. The process of claim 6 wherein the binder resin or polymer comprises an epoxide-based, water-soluble resin and the precipitating agent comprises an anionic precipitating agent.

8. The process of claim 7 wherein the binder resin or polymer comprises polyamido/polyamino-epichlorohydrin resin.

9. The process of claim 8 wherein the precipitating agent comprises a water-soluble, thermosetting acrylic resin.

10. The process of claim 1 wherein excess emulsion or suspension is removed prior to drying the wetted microfibrous structure.

11. The process of claim 1 wherein the microfibrous structure comprises an annular, cylindrical microfibrous structure with structural rigidity.

12. The process of claim 11 wherein the impregnating of the microfibrous structure is carried out by spinning the annular cylindrical microfibrous structrure in a substantially horizontal position and inserting the stable emulsion or suspension into the interior thereof.

13. A process for converting an annular, cylindrical, structurally rigid, hydrophobic, polymeric, microfibrous structure comprised of polypropylene microfibers to a hydrophilic form exhibiting a positive zeta potential comprising:

(1) combining in a controlled manner (a) a first solution of a polyamido/polyamino-ephichlorohydrin binder resin in a solvent of t-butyl alcohol and water, and (b) a second solution of a water-soluble, thermosetting acrylic resin precipitating agent in a solvent of t-butyl alcohol and water to form a stable emulsion or suspension of the precipitating agent and the binder resin as co-precipitates;

(2) impregnating the microfibrous structure with the stable emulsion or suspension to form a microfibrous structure wetted with the stable emulsion or suspension; and (3) drying the wetted microfibrous structure of step (2) and curing the binder resin to provide a hydrophilic, polymeric, microfibrous structure with a positive zeta potential, the surfaces of the microfibers of the structure being coated with a cured, precitated, thermoset polyamido/polyaminoepichlorohydrin resin.

14. The process of claim 13 wherein the impregnating of the microfibrous structure is carried out by spinning the annular, cylindrical microfibrous structure in a substantially horizontal position and inserting the stable emulsion or suspension into the interior thereof.

15. A three-dimensional, polymeric, microfibrous structure with structural rigidity comprising normally hydrophobic microfibers coated with a cured, precipitated, cationic, thermoset binder resin or polymer, said structure characterized by being hydrophilic and having a positive zeta potential and enhanced capability for the removal of negatively-charged particulate material in a fluid medium.

16. The structure of claim 15 wherein the microfibers of the microfibrous structure comprise a polymer selected from the group consisting of polyolefins, polyamides, and polyesters.

17. The structure of claim 16 wherein the binder resin is present in the hydrophilic structure in an amount in the range of from about 0.5 to about 4 weight percent.

18. The structure of claim 17 wherein the binder resin is present in the hydrophilic structure in an amount in the range of from about 0.8 to about 3 weight percent.

19. The structure of claim 16 wherein the microfibers of the microfibrous structure comprise polypropylene.

20. The structure of claim 19 wherein the binder resin or polymer comprises an epoxide-based, thermoset resin.

21. The structure of claim 20 wherein the binder resin or polymer comprises a thermoset polyamido/-polyamino-epichlorohydrin.

22. The structure of claim 15 wherein said microfibrous structure comprises an annular, cylindrical microfibrous structure.

23. An annular, cylindrical microfibrous structure with structural rigidity comprising normally hydrophobic polypropylene microfibers coated with a cured, precipitated, cationic, thermoset, polyamido/-polyamino-epichlorohydrin, said structure characterized by being hydrophilic and having a positive zeta potential and enhanced capability for the removal of negatively-charged particulate material in a fluid medium.

* * * * *